US008776700B2

(12) United States Patent
Faussone

(10) Patent No.: US 8,776,700 B2
(45) Date of Patent: Jul. 15, 2014

(54) SYSTEM AND PROCESS FOR THE PYROLYSATION AND GASIFICATION OF ORGANIC SUBSTANCES

(76) Inventor: Elio Faussone, Turin (IT)

( * ) Notice: Subject to any disclaimer, the term of this patent is extended or adjusted under 35 U.S.C. 154(b) by 548 days.

(21) Appl. No.: 13/255,088

(22) PCT Filed: Mar. 26, 2009

(86) PCT No.: PCT/IT2009/000118

§ 371 (c)(1),
(2), (4) Date: Sep. 6, 2011

(87) PCT Pub. No.: WO2010/109501

PCT Pub. Date: Sep. 30, 2010

(65) Prior Publication Data

US 2012/0003594 A1 Jan. 5, 2012

(51) Int. Cl.

| | |
|---|---|
| ***F23G 5/12*** | (2006.01) |
| ***C10J 3/66*** | (2006.01) |
| ***C10J 3/52*** | (2006.01) |
| ***C10J 3/42*** | (2006.01) |

(52) U.S. Cl.

CPC .... *C10J 3/52* (2013.01); *C10J 3/66* (2013.01); *C10J 2300/0909* (2013.01); *C10J 3/42* (2013.01)

USPC ..... 110/229; 110/227; 110/228; 110/346; 126/152 R

(58) Field of Classification Search

CPC ..... B09B 3/00; C02F 11/10; C10J 2200/156; C10J 2300/0946; C10J 3/482; C10J 3/523; F23H 9/00; Y02E 20/18; Y02E 50/14; Y02E 50/32

USPC ..... 110/229, 346, 227, 228; 126/152 R, 126/169, 171, 176 R

See application file for complete search history.

(56) References Cited

U.S. PATENT DOCUMENTS 233,652 A * 10/1880 Wood ..... 126/171
1,346,905 A * 7/1920 McGoldrick ..... 209/326

(Continued)

FOREIGN PATENT DOCUMENTS

| | | |
|---|---|---|
| DE | WO 86/05198 A1 | 9/1986 |
| GB | 21697 A | 0/1914 |
| ZA | WO 03/018720 A2 | 3/2003 |

OTHER PUBLICATIONS

Faussone, Elio, International Search Report issued for parent PCT/IT2009/000118 on Jul. 19, 2010.

*Primary Examiner* — Jorge Pereiro
(74) *Attorney, Agent, or Firm* — David A. Farah; Sheldon Mak & Anderson PC

(57) ABSTRACT

A system is described for the pyrolysation and gasification of organic substances, in particular biomasses, comprising in cascade at least one evaporation module, at least one pyrolysis reactor and at least one gassing device, such evaporation module being supplied with the organic substance, to be dried and then be transferred through first supplying means in such pyrolysis reactor to be subjected to a pyrolysis process for producing at least one pyrolysis fuel syngas and remaining organic products, the remaining organic products being then transferred through second supplying means to such gassing device to produce at least one gasification fuel syngas, further comprising first channelling means for such pyrolysis fuel syngas and such gasification fuel syngas from such pyrolysis reactor to at least one energy user, second channelling means of burnt exhaust gases produced by such energy user towards such evaporation module, and third channelling means of such gasification fuel syngas from such gassing device to such pyrolysis module. A process is further described for the pyrolysation and gasification of organic substances through such system.

22 Claims, 1 Drawing Sheet

(56) References Cited

U.S. PATENT DOCUMENTS

| | | | | | |
|---|---|---|---|---|---|
| 2,010,527 | A | * | 8/1935 | Rinfret | 126/171 |
| 2,241,424 | A | * | 5/1941 | Sanford | 110/190 |
| 4,069,024 | A | * | 1/1978 | Fernandes | 48/197 R |
| 4,225,392 | A | * | 9/1980 | Taylor | 202/93 |
| 4,486,199 | A | * | 12/1984 | Schenone et al. | 48/197 R |
| 4,583,992 | A | * | 4/1986 | Rogers | 48/76 |
| 4,919,763 | A | * | 4/1990 | Hinger | 202/113 |
| 4,967,673 | A | * | 11/1990 | Gunn | 110/346 |
| 5,230,716 | A | * | 7/1993 | Notestein | 48/62 R |
| 5,626,638 | A | * | 5/1997 | Valkanas | 48/197 R |
| 6,960,234 | B2 | * | 11/2005 | Hassett | 48/77 |
| 2003/0008928 | A1 | | 1/2003 | Klepper | |
| 2010/0050515 | A1 | * | 3/2010 | Wakefield et al. | 48/77 |
| 2011/0104575 | A1 | * | 5/2011 | Mui et al. | 429/401 |

* cited by examiner

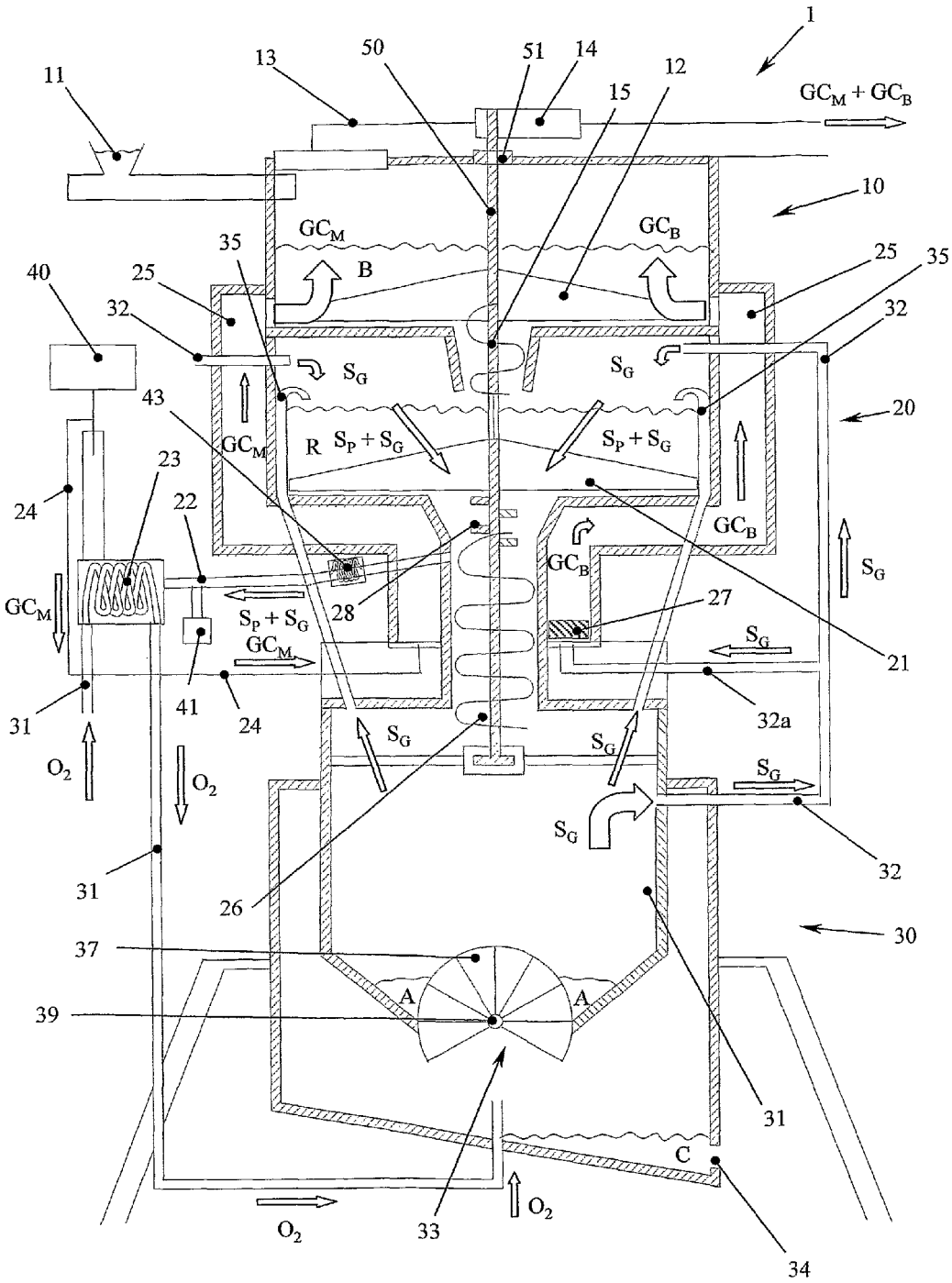
1
11
13
50
51
14
12
15
$GC_M + GC_B$
10
$GC_M$
$GC_B$
B
35
25
40
32
$S_G$
43
20
R
$S_P + S_G$
23
24
22
28
27
21
$S_P + S_G$
$GC_M$
41
24
31
32a
$O_2$
26
37
30
A
39
C
33
34

SYSTEM AND PROCESS FOR THE PYROLYSATION AND GASIFICATION OF ORGANIC SUBSTANCES

CROSS-REFERENCE TO RELATED APPLICATION

The present Application is a national stage of International Patent Application No. PCT/IT2009/000118, titled "System and Process for the Pyrolysation and Gasification of Organic Substances," filed Mar. 26, 2009, the contents of which are incorporated in this disclosure by reference in their entirety.

FIELD OF THE INVENTION

The present invention refers to a system and a process for the pyrolysation and gasification of organic substances, such as in particular biomasses.

BACKGROUND OF THE INVENTION

As known, pyrolysers are reactors adapted to perform the pyrolysis process: pyrolysis is a process for the thermo-chemical decomposition of organic substances, such as for example biomasses, obtained by applying heat, and with a complete absence of an oxidising agent, normally oxygen, to perform a thermally induced homolysis: under such conditions, the organic substance is subjected to scission of original chemical links, forming simpler molecules.

It is also known that gassing devices exploit the same pyrolysis reaction through heating at the presence, however, of reduced amounts of oxygen: under these conditions, the organic substances are completely destroyed, dividing their molecules, generally long carbon chains, into simpler molecules of carbon monoxide, hydrogen and natural gas, that form a synthesis gas (syngas), mostly composed of natural gas and carbon dioxide, and sometimes pure enough to be used as such. Different from pyrolysers, which strictly perform the pyrolysis, namely with a complete lack of oxygen, the gassing devices, operating instead with small amounts of such element, also produce a partial oxidation. Currently, if organic substances are composed of biomasses, energy captured through the photosynthesis in such substances is freed, either by burning the syngas in a burner to exploit its heat or supply a steam turbine, or by using it as fuel for explosion engines, or obtaining hydrogen therefrom to be then used as fuel cells to produce electricity.

In a more and more growing context of searches for new alternative sources of energy production and waste disposal, the use of pyrolysers or gassing devices for thermo-valorising biomasses and wastes like agricultural and agro-industrial residuals, agricultural and forest virgin biomasses, forest and forest-cultivating residuals, wood and paper working residuals, allows obtaining great advantages, such as a reduced environmental impact both as regards production and as regards transport of produced syngas and good opportunities to re-use the resulting heat.

The prior art, however, does not propose solutions that provide for a combined, synergic and integrated use of at least one pyrolyser and at least one gassing device in a single integrated system, in such a way as to best optimise the operation through suitable thermal and energy cooperation. From the prior art, some systems are known, such as those disclosed in patents n. WO2007077685, US7,214,252, WO2007045291, NZ542062, US2007012229, KR940002987, KR20020093711, KR20020048344, CN2811769Y, that however are still very far from obtaining high efficiencies, since they do not provide for an actually synergic and optimised cooperation between their various components, in particular for pyrolysation and gasification.

SUMMARY OF THE INVENTION

Therefore, object of the present invention is solving the above prior art problems, by providing a system and a process for the pyrolysation and gasification of organic substances, such as in particular biomasses, that allow a synergic operation between at least one pyrolysation reactor and at least one gassing device in a single integrated system, allowing to obtain higher efficiencies than those of prior art systems.

The above and other objects and advantages of the invention, as will appear from the following description, are obtained with a system for the pyrolysation and gasification of organic substances as described in claim 1.

Moreover, the above and other objects and advantages of the invention are obtained with a process for the pyrolysation of organic substances as described in claim 16.

Preferred embodiments and non-trivial variations of the present invention are the subject matter of the dependent claims.

It will be immediately obvious that numerous variations and modifications (for example related to shape, sizes, arrangements and parts with equivalent functionality) can be made to what is described, without departing from the scope of the invention as appears from the enclosed claims.

BRIEF DESCRIPTION OF THE DRAWINGS

The present invention will be better described by some preferred embodiments thereof, provided as a non-limiting example, with reference to the enclosed drawings, in which the only FIG. 1 shows a side sectional view of a preferred embodiment of the system for the pyrolysation and gasification of organic substances according to the present invention.

DETAILED DESCRIPTION OF PREFERRED EMBODIMENTS

With reference then to FIG. 1, it is possible to note that the system 1 for the pyrolysation and gasification of organic substances, in particular biomasses, according to the present invention comprises in cascade, preferably with a vertically developing arrangement, at least one evaporation module 10, at least one pyrolysis reactor 20 and at least one gassing device 30, in which the evaporation module 10 is supplied with the organic substance B, for example through at least one loading hopper 11, in which this latter one is dried before being transferred through first supplying means 15 in the pyrolysis reactor 20 to be subjected to a pyrolysis process for producing at least one pyrolysis fuel syngas $S_P$ and remaining organic products R with an energy content, these latter ones being then transferred, possibly through second supplying means 26, to the gassing device 30 to produce at least one gasification fuel syngas $S_G$, further comprising first channelling means of the pyrolysis fuel syngas $S_P$ and the gasification fuel syngas $S_G$ from the pyrolysis reactor 20 towards at least one energy user 40, second channelling means of burnt exhaust gases $GC_M$ produced by the energy user 40 towards the evaporation module 10, and third channelling means of the gasification fuel syngas $S_G$ from the gassing device 30 to the pyrolysis module 20.

The gassing device 30 is further, obviously, supplied with oxygen $O_2$ from fourth channelling means.

Possibly, the system 1 can further comprise at least fifth channelling means of the gasification fuel syngas $S_G$ from the gassing device 30 towards at least one burner 27, whose burnt exhaust gases $GC_B$ are channelled towards the evaporation module 10, possibly by interposing at least one interspace 25 of the pyrolysis reactor 20.

In particular, the pyrolysis reactor 20 is preferably a rotary mixer pyrolyser 21, composed of a cylinder made of refractory steel insulated by means of a liner composed of insulating material; inside the pyrolysis reactor 20, biomass B, coming from the evaporation module 10 through the first supplying means 15, is degraded at high temperature and without oxygen, producing the pyrolysis fuel syngas $S_P$ and the remaining organic products R, mainly composed of a fuel solid (char) whose energy characteristics are similar to lignite, and an oily-tarry residual (tar), also with an interesting energy content. The pyrolysis syngas $S_P$ and the gasification syngas $S_G$, present inside the pyrolysis reactor 20 for the reasons stated below, are then taken from the pyrolysis reactor 20 through the first channelling means realised as at least one first duct 22 to supply, by interposing at least one air/air heat exchanger 23 mentioned below, the energy user 40 such as, for example, a generator set, with gas turbine or alternate motor, for producing electric energy.

Preferably, along the first duct 22, it is possible to introduce steam inside the pyrolysis syngas $S_P$ and the gasification syngas $S_G$, through suitable supply means 41, to favour the metanisation reaction:

$$2CO+4H_2O \rightarrow 2CH_4+3O_2$$

Since the above reaction is highly endothermic, the first duct 22 is preferably completely coated with a thermally refractory concrete.

To prevent organic residuals R from going out, the first duct 22 can further be equipped with at least one barrier scroll 43. The barrier scroll 43 further allows elongating the path made by the pyrolysis syngas $S_P$ and the gasification syngas $S_G$ inside the first duct 22 further favouring the completion of the above metanisation reaction.

Burnt exhaust gases $GC_M$ produced by the energy user 40 are then channelled through the second channelling means realised as at least one second duct 24 to be re-inserted inside the evaporation module 10, possibly by interposing at least one interspace 25 of the pyrolysis reactor 20, in order to pass upwards through the biomass B present inside and perform its drying.

The gassing device 30, placed downstream of the pyrolysis reactor 20, is supplied with the remaining organic products R coming from the pyrolysis reactor 20 itself through the second supplying means and with oxygen $O_2$ through the fourth channelling means, realised as at least one fourth duct 31, by interposing the air/air heat exchanger 23 to produce the gasification syngas $S_G$ through a gasification reaction; in particular, oxygen $O_2$ is heated in the air/air heat exchanger 23 by the pyrolysis syngas $S_P$ and the gasification syngas $S_G$ coming from the pyrolysis reactor 20 obtaining the double purpose of providing heat to the gassing device 30 necessary for the gasification reaction through heated oxygen $O_2$ and cool the pyrolysis syngas $S_P$ and the gasification syngas $S_G$, consequently recovering calories, before inserting them in the energy user 40 in which the presence of excessively hot gases would be a useless waste of thermal energy.

In particular, the fourth duct 31 is supplied from the bottom by the gassing device 30 with oxygen $O_2$, doing without the so-called "down draft" supply system present in known gassing devices.

The gasification syngas $S_G$ is therefore taken from the gassing device 30 through the third channelling means realised, for example, as at least one third duct 32 to be re-inserted at high temperature inside the pyrolysis reactor 20 in order to provide heat and support the pyrolysis process.

Alternatively, the third channelling means can comprise at least one shower-type duct 35 (merely as an example, in the system 1 of FIG. 1, two shower-type ducts are shown) suitable to re-insert the gasification syngas $S_G$ inside the pyrolysis reactor 20, taking it from the gassing device 30. Possibly, it is possible to also provide that the gasification syngas $S_G$ is re-inserted inside the pyrolysis reactor 20 through third channelling means, simultaneously comprising both the third ducts 32 and the shower-type ducts 35.

Through the fifth channelling means, preferably realised as at least one by-pass duct 32*a* of the third duct 32 and/or the shower-type duct 35, the gasification syngas $S_G$ is further channelled towards the burner 27 and the burnt exhaust gases $GC_B$ are re-inserted in the evaporation module 10, possibly through the interspace 25 of the pyrolysis reactor 20, in order to integrate the burnt exhaust gases $GC_M$ to pass upwards through the biomass B present inside and perform its drying.

On the lower part, the gassing device 30 can be equipped with at least one motored grid 33, at least with semi-spherical shape, as replacement of traditional plane grids of prior art gassing devices. In fact, it is known that plane grids suffer the inconvenience of being often clogged with resulting aggregates coming from the pyrolysis reactor 20, preventing the passage of oxygen $O_2$ and requiring to stop the pyrolisation and gasification reactor in order to take care of cleaning the grid itself. Advantageously, instead, the motored semi-spherical grid 33 of the system 1 according to the present invention is composed of at least one dome 37, at least with a semi-spherical shape with metallic grid, rotatingly hinged around at least one rotation axis 39 driven in rotation by at least one actuating motor (not shown). Therefore, starting from a starting position, for example the one shown in FIG. 1, under the action of the actuating motor, the dome 37 is taken to oscillate around such rest position in order to disaggregate possible resulting aggregates A, such as low-melting materials, having been deposited between the dome 37 itself and the walls of the gassing device 30, allowing the passage through the grid. It is further possible to provide that, periodically, always under the action of the actuating motor, the dome 37 performs a 360° rotation around the rotation axis 39, thereby allowing the passage of all aggregates A towards a discharge opening 34.

The motored semi-spherical grid 33 therefore performs the tasks of:

- allowing heated oxygen $O_2$ to re-circulate inside it, making more efficient and smoother both the gasification reaction, and the passage of the gasification syngas $S_G$ towards the third duct 32 and/or the shower-type duct 35 and exiting the ashes C produced by the gasification process and the aggregate powders A, so that they can afterwards be removed through at least one discharge opening 34;
- providing a self-cleaning system for the dome 37;
- providing, with the same overall plan sizes, a greater exchange surface with respect to plane grids;
- reducing the grid clogging problems and, consequently, the stop times of the system 1.

In order to anyway avoid the thermal deterioration or, even more, the melting of the motored semi-spherical grid 33, oxygen $O_2$ supplied from the bottom to the gassing device 30 through the fourth duct 31 can be mixed with steam or nebulised water.

Between the pyrolysis reactor 20 and the gassing device 30, upstream of the second supplying means, it is further possible to provide at least one area equipped with filtering means 28 of the remaining organic products R before inserting them inside the gassing device 30 itself.

In order to allow a more efficient extraction of the burnt exhaust gases $GC_B$ e $GC_M$ and the evaporation vapours of the biomass B contained inside the evaporation module 10, this latter one is equipped on its upper part with at least one fume exhaust duct 13, possibly cooperating with at least one exhauster or extractor 14.

The first and second supplying means, respectively 15 and 26, are preferably realised as sealed worm screws. In a more simplified embodiment thereof, their rotation could be controlled by a single drive shaft 50 coaxial therewith actuated by at least one engine 51, that possibly rotates also the rotary mixer 21 of the pyrolysis reactor 20 and/or possibly a mixer 12 of the evaporation module 10. Since however the times for supplying the biomass B from the evaporation module 10 to the pyrolysis reactor 20 can be substantially different from the times for supplying the remaining organic products R from the pyrolysis reactor 20 to the gassing device 30, it is clear that a rotation at the same angular speed of the first and second supplying means would be counterproductive for an operation of the system 1 according to the present invention that allows obtaining the best possible efficiency. For such reason, in an alternative embodiment thereof (not shown), the first and second supplying means are rotatingly driven by at least two different rotation shafts that, however, due to reasons of space reduction, and building and operating symmetry of the system 1, appear as rotation shafts one as liner of the other with the same rotation axes: in this way, it is possible to allow a rotation of the first and second supplying means with different angular speeds, depending on the actual supply needs of the various components of the system 1 according to the present invention.

The present invention further refers to a process for the pyrolysation and gasification of organic substances, such as in particular biomasses, through a system 1 as previously described. In particular (with reference to a steady state operation of the system 1), the process according to the present invention comprises the steps of:

a) inserting a biomass B inside the evaporation module 10;

b) drying the biomass B by means of the burnt exhaust gases $GC_M$ produced by the energy unit 40 and the burnt exhaust gases $GC_B$ produced by the burner 27;

c) transferring the biomass B from the evaporation module 10 to the pyrolysis reactor 20 through the first supplying means;

d) inserting the gasification syngas $S_G$ from the gassing device 30 into the pyrolysis reactor 20;

e) performing a pyrolysis reaction of the biomass B inside the pyrolysis reactor 20 to generate pyrolysis syngas $S_P$;

f) transferring the remaining organic products R of the pyrolysis reaction from the pyrolysis reactor 20 to the gassing device 30, possibly through the second supplying means;

g) transferring the pyrolysis syngas $S_P$ and the gasification syngas $S_G$ from the pyrolysis reactor 20 to the energy user 40 passing through the air/air heat exchanger 23; possibly, mixing the pyrolysis syngas $S_P$ and the gasification syngas $S_G$ with steam before the air/air heat exchanger 23 in order to favour a metanisation reaction of such syngas;

h) transferring the burnt exhaust gases $GC_M$ from the energy unit 40 to the evaporation module 10;

i) supplying the gassing device 30 with oxygen $O_2$ passing through the air/air heat exchanger 23;

j) performing a gasification reaction of the remaining organic products R inside the gassing device 30 to generate gasification syngas $S_G$;

k) transferring the gasification syngas $S_G$ from the gassing device 30 to the pyrolysis reactor 20;

l) transferring the gasification syngas $S_G$ from the gassing device 30 to the burner 27;

m) transferring the burnt exhaust gases $GC_B$ from the burner 27 to the evaporation module 10; and n) cyclically repeating steps a) to m).

The invention claimed is:

1. A system for a pyrolysation and gasification of organic substances, in particular biomasses, the system comprising in cascade at least one evaporation module, at least one pyrolysis reactor and at least one gassing device, the evaporation module being supplied with the organic substance to be dried and then be transferred through first supplying means to the pyrolysis reactor to be subjected to a pyrolysis process for producing at least one pyrolysis fuel syngas and remaining organic products as residuals, the organic products as residuals being then transferred through second supplying means to the gassing device for producing at least one gasification fuel syngas, the system further comprising first channeling means of the pyrolysis fuel syngas and of the gasification fuel syngas from the pyrolysis reactor to at least one energy user, second channeling means of burnt exhaust gases produced by the energy user towards the evaporation module, and third channeling means of the gasification fuel syngas from the gassing device to the pyrolysis module, the gassing device being equipped with at least one motored grid comprising a semi-spherical shape;

wherein the first and second supplying means are sealed worm screws connected to a drive shaft coaxial therewith actuated in rotation by at least one engine: and wherein the drive shaft rotates the rotary mixer or rotates a mixer of the evaporation module or rotates both the rotary mixer and a mixer of the evaporation module.

2. The system of claim 1, wherein the motored semi-spherical grid comprises at least one dome comprising a semi-spherical shape equipped with a metallic grid, rotatingly hinged around at least one rotation axis rotatingly driven by at least one actuating motor.

3. The system of claim 2, wherein the actuating motor is adapted to bring the dome to oscillate around a rest position.

4. The system of claim 2, wherein the actuating motor makes the dome rotate at least by 360°.

5. The system of claim 1, further comprising at least fifth channeling means of the gasification fuel syngas from the gassing device to at least one burner, burnt exhaust gases of the burner being channeled towards the evaporation module.

6. The system of claim 5, wherein the burnt exhaust gases of the burner are channeled towards the evaporation module by interposing at least one interspace of the pyrolysis reactor.

7. The system of claim 6, wherein the burnt exhaust gases of the energy user are channeled towards the evaporation module by interposing the interspace.

8. The system of claim 1, wherein the evaporation module is supplied with the organic substance through at least one loading hopper.

9. The system of claim 1, wherein the pyrolysis reactor is a rotary mixer pyrolyser.

10. The system of claim 1, wherein the first channeling means are at least one first duct equipped with at least one air/air heat exchanger .

11. The system of claim 10, wherein the first duct is equipped with at least one barrier scroll.

12. The system of claim 10, wherein, along the first duct, the pyrolysis syngas fuel gas and the gasification syngas fuel gas are mixed with steam to perform a metanisation reaction.

13. The system of claim 10, wherein the gassing device is supplied from the bottom with oxygen through fourth channeling means and heated through the pyrolysis syngas and gasification syngas in the air/air heat exchanger.

14. The system of claim 1, wherein the burnt exhaust gases of the energy user are channeled towards the evaporation module by interposing an interspace.

15. The system of claim 1, wherein the gassing device is supplied from the bottom with oxygen through fourth channeling means and heated through the pyrolysis syngas and gasification syngas in an air/air heat exchanger.

16. The system of claim 13, wherein the oxygen supplied from the bottom to the gassing device, is mixed with steam or nebulized water.

17. The system of claim 1, wherein between the pyrolysis reactor and the gassing device, upstream of the second supplying means, filtering means are arranged for the organic products as residuals before inserting the organic products as residuals inside the gassing device.

18. The system of claim 1, wherein on its upper side the evaporation module is equipped with at least one exhaust duct of the burnt exhaust gases and of vapors of the organic substance.

19. The system of claim 18, wherein the exhaust duct is equipped with at least one exhauster or extractor of the gases and vapours.

20. The system of claim 1, wherein the first and second supplying means are sealed worm screws rotatingly driver by at least two different rotation shafts, one placed as liner of the other with the same rotation axes.

21. The system of claim 1, wherein the third channeling means comprise at least one shower-type duct adapted to re-insert the gasification syngas to the pyrolysis reactor from the gassing device.

22. A process for a pyrolysation and gasification of organic substances, such as in particular biomasses, by means of the system of claim 1, the process comprising the steps of:

a) inserting the biomass inside the evaporation module;

b) drying the biomass through burnt exhaust gases produced by the energy unit and the burnt exhaust gases produced by the burner;

c) transferring the biomass from the evaporation module to the pyrolysis reactor through the first supplying means;

d) inserting the gasification syngas from the gassing device into the pyrolysis reactor;

e) performing a pyrolysis reaction of the biomass inside the pyrolysis reactor to generate the pyrolysis syngas;

f) transferring the remaining organic products of the pyrolysis reaction from the pyrolysis reactor to the gassing device through the second supplying means;

g) transferring the pyrolysis syngas and the gasification syngas from the pyrolysis reactor to the energy user passing through an air/air heat exchanger, and possibly mixing the pyrolysis syngas and the gasification syngas with steam before the air/air heat exchanger;

h) transferring the burnt exhaust gases from the energy unit to the evaporation module;

i) supplying the gassing device with oxygen passing through the air/air heat exchanger;

j) performing a gasification reaction of the remaining organic products inside the gassing device to generate the gasification syngas;

k) transferring the gasification syngas from the gassing device to the pyrolysis reactor;

l) transferring the gasification syngas from the gassing device to the burner;

m) transferring the burnt exhaust gases from the burner to the evaporation module; and n) cyclically repeating steps a) to m).

* * * * *